US012344359B1

(12) United States Patent
Wang et al.

(10) Patent No.: US 12,344,359 B1
(45) Date of Patent: Jul. 1, 2025

(54) CATCHING DEVICE FOR SURFACE RESCUE BASED ON AIRCRAFT PLATFORM AND SURFACE RESCUE METHOD

(71) Applicant: Beihang University, Beijing (CN)

(72) Inventors: Lijing Wang, Beijing (CN); Tianyang Cai, Beijing (CN); Yanzeng Zhao, Beijing (CN); Chuanlei Zhu, Beijing (CN); Haixin Xu, Beijing (CN); Yunan Zou, Beijing (CN); Runhao Li, Beijing (CN); Jiaying Zou, Beijing (CN); Jun Zhang, Beijing (CN)

(73) Assignee: Beihang University, Beijing (CN)

( * ) Notice: Subject to any disclaimer, the term of this patent is extended or adjusted under 35 U.S.C. 154(b) by 0 days.

(21) Appl. No.: 19/063,385

(22) Filed: Feb. 26, 2025

(30) Foreign Application Priority Data

Feb. 27, 2024 (CN) ..... 202410215101.4

(51) Int. Cl.
*B63C 9/01* (2006.01)

(52) U.S. Cl.
CPC ..... *B63C 9/01* (2013.01)

(58) Field of Classification Search
CPC ..... B63C 9/01
See application file for complete search history.

(56) References Cited

U.S. PATENT DOCUMENTS

2015/0377405 A1* 12/2015 Down ..... G05D 1/104 244/76 R
2021/0053684 A1* 2/2021 Dürr ..... B64F 1/20

FOREIGN PATENT DOCUMENTS

| | | | | |
|---|---|---|---|---|
| CN | 203844986 U | | 9/2014 | |
| CN | 204056259 U | * | 12/2014 | |
| CN | 205168851 U | | 4/2016 | |
| CN | 112660382 A | | 4/2021 | |
| CN | 116101458 A | | 5/2023 | |
| JP | 2014008912 A | | 1/2014 | |
| WO | WO-2004027434 A1 | * | 4/2004 | ..... A63H 27/04 |
| WO | 2023064434 A1 | | 4/2023 | |

* cited by examiner

*Primary Examiner* — Stephen P Avila
(74) *Attorney, Agent, or Firm* — Bayramoglu Law Offices LLC

(57) ABSTRACT

Provided is a catching device for surface rescue based on an aircraft platform, and a surface rescue method. The catching device for surface rescue based on the aircraft platform includes a throwing mechanism, a flying mechanism, a recovery mechanism, an automatic control module, and a catching net. Both the throwing mechanism and the recovery mechanism are disposed on the flying mechanism, and the automatic control module automatically controls the throwing mechanism and the recovery mechanism. After the flying mechanism flies above a drowning person, the throwing mechanism is configured to throw the catching net towards the drowning person. After the catching net nets the drowning person, the recovery mechanism can drive a bottom of the catching net to close and lift the catching net upwards to approach the flying mechanism, and the flying mechanism is configured to drag the drowning person to a safe location.

8 Claims, 6 Drawing Sheets

CATCHING DEVICE FOR SURFACE RESCUE BASED ON AIRCRAFT PLATFORM AND SURFACE RESCUE METHOD

CROSS REFERENCE TO THE RELATED APPLICATIONS

This application is based upon and claims priority to Chinese Patent Application No. 202410215101.4, filed on Feb. 27, 2024, the entire contents of which are incorporated herein by reference.

TECHNICAL FIELD

The present disclosure relates to the technical field of intelligent life-saving equipment, and in particular, to a catching device for surface rescue based on an aircraft platform, and a surface rescue method.

BACKGROUND

In current offshore environments, especially in distant-sea environments, there are two main methods for using an aircraft platform to rescue a drowning person and catch a floating object. In a first method, a helicopter is used for double lifting. That is, the helicopter first drops a lifeguard carrying a lifebelt. Then, the lifeguard quickly approaches the drowning person and helps the drowning person put on the lifebelt, and then the lifeguard hugs the drowning person and delivers a hoisting signal to rescue personnel in the helicopter. Finally, when the lifeguard and the drowning person approach a door of the helicopter, the flight crew will assist the lifeguard and the drowning person in entering the helicopter. In a second method, a drone is used to airdrop rescue equipment. That is, the drone approaches the drowning person, drops the rescue equipment to the drowning person, and the drowning person performs self-rescue. In the first method, the rescue personnel are required. This rescue method is time-consuming and labor-intensive, lacks good rescue auxiliary equipment, has a high risk, and cannot be quickly implemented due to safety of the rescue personnel in a dangerous environment. In the second method, no rescue personnel are required, but life-saving equipment can only be operated by the drowning person and cannot actively adapt to a status of the drowning person and a marine environment, which cannot meet current needs of quickly rescuing severely injured and disabled persons and salvaging floating materials on a sea surface.

SUMMARY

An objective of the present disclosure is to provide a catching device for surface rescue based on an aircraft platform, and a surface rescue method, to solve problems existing in the prior art, break through shortcomings of a traditional rescue method in terms of rescue efficiency, safety, and reliability, and solve a problem of rescuing a drowning person at sea.

To achieve the foregoing objective, the present disclosure provides the following solutions:

The present disclosure provides a catching device for surface rescue based on an aircraft platform, including a throwing mechanism, a flying mechanism, a recovery mechanism, an automatic control module, and a catching net, where both the throwing mechanism and the recovery mechanism are disposed on the flying mechanism, and the automatic control module automatically controls the throwing mechanism and the recovery mechanism;

after the flying mechanism flies above a drowning person, the throwing mechanism is configured to throw the catching net towards the drowning person; and after the catching net nets the drowning person, the recovery mechanism is capable of driving a bottom of the catching net to close and lifting the catching net upwards to approach the flying mechanism, and the flying mechanism is configured to drag the drowning person to a safe location.

Preferably, a recognition module is further included, which is disposed on the flying mechanism, where when the flying mechanism reaches a rescue position, the recognition module is configured to determine a relative position between the drowning person and the rescue position; and if it is determined that the relative position is within a horizontal distance error $\Delta x$ and a height difference $h_1$, the automatic control module controls the throwing mechanism to throw the catching net towards the drowning person.

Preferably, the throwing mechanism includes a torque output unit and a linear drive unit, where the linear drive unit is connected to the flying mechanism, the torque output unit is disposed at a linear displacement end of the linear drive unit, the linear displacement end drives the torque output unit to move up and down, a torque output end of the torque output unit is connected to a top of the catching net, and the torque output unit drives the catching net to rotate and unfold.

Preferably, when controlling the throwing mechanism to throw the catching net, the automatic control module first controls the torque output unit to output a torque, and when the recognition module recognizes that an unfolded range of the catching net is within an $S_1$ range, controls the linear drive unit to drive the torque output unit and the catching net above the torque output unit to move down until a lower edge of the catching net enters water and a rescue person is netted; and after the bottom of the catching net is closed, the linear drive unit is capable of driving the throwing mechanism to further drive the catching net and the drowning person inside the catching net to move up.

Preferably, the recovery mechanism includes a winding engine and a plurality of ropes, where one end of each of the ropes is wound around a drum of the winding engine and the other end is connected to the lower edge of the catching net, and the ropes are arranged around a circumference of the catching net; and the winding engine drives the drum to rotate and winds the rope onto the drum to close the bottom of the catching net and raise a height of the catching net.

Preferably, a carrying platform is further included, where the flying mechanism is an aircraft, the throwing mechanism is disposed on the carrying platform, and the carrying platform is disposed between two suspension beams at a bottom of the aircraft.

Preferably, the lower edge of the catching net is equipped with a gravity loop, and the gravity loop includes a retractable rope loop and a plurality of sinkers sequentially arranged around a circumference of the retractable rope loop.

The present disclosure further provides a surface rescue method, including:

step 1: after receiving a task, flying, by a flying mechanism automatically or under manual control, to a rescue position;

step 2: determining whether a horizontal position error and a vertical relative height between the rescue position and a drowning person are within specified thresholds;

step 3: controlling a throwing mechanism to throw a catching net towards the drowning person;

step 4: driving, by a recovery mechanism, a bottom of the catching net to close, and lifting the catching net upwards to approach the flying mechanism; and step 5: flying, by the flying mechanism automatically or under the manual control, and dragging the drowning person to a safe location.

Compared with the prior art, the present disclosure achieves the following technical effects:

1. The present disclosure utilizes a throwing mechanism, a flying mechanism, a recovery mechanism, an automatic control module, and a catching net to achieve intelligent surface rescue. The present disclosure breaks through shortcomings of a traditional rescue method in terms of rescue efficiency, safety, and reliability, and solves a problem of rescuing a drowning person at sea.
2. The present disclosure can save rescue costs and time, and reduce a waste of rescue resources. The present disclosure can utilize low-cost rescue carriers such as a drone, imposing low requirements for weather, a sea condition, and other factors. A catching net is of a stretchable mesh structure, which is lightweight, structurally simple, and functionally powerful. The present disclosure can reduce reliance on other rescue forces, thereby improving rescue efficiency and a success rate.
3. The present disclosure can ensure life safety of the drowning person at sea and reduce mortality and disability rates of a drowning accident at sea. The present disclosure can rescue the drowning person from danger in a relatively short period of time and sent the drowning person to a safe location. The present disclosure can improve a safety level of industries such as maritime tourism, transportation, and fisheries, and ensure development of social economy.

BRIEF DESCRIPTION OF THE DRAWINGS

To describe the technical solutions in embodiments of the present disclosure or in the prior art more clearly, the accompanying drawings required for the embodiments are briefly described below. Apparently, the accompanying drawings in the following description show merely some embodiments of the present disclosure, and those of ordinary skill in the art may still derive other accompanying drawings from these accompanying drawings without creative efforts.

In the figures, 1: flying mechanism; 2: catching net; 3: suspension beam; 4: carrying platform; 5: throwing net wheel; 6: drum; 7: control signal transmission module for a winding engine; 8: first motor; 9: driving gear; 10: second motor; 11: control signal transmission module for a throwing mechanism; 12: linear drive unit; 13: torque output unit.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

An objective of the present disclosure is to provide a catching device for surface rescue based on an aircraft platform, and a surface rescue method, to solve problems existing in the prior art, break through shortcomings of a traditional rescue method in terms of rescue efficiency, safety, and reliability, and solve a problem of rescuing a drowning person at sea.

In order to make the above objective, features and advantages of the present disclosure clearer and more comprehensible, the present disclosure will be further described in detail below in combination with the accompanying drawings and particular implementations.

Embodiment 1

Figure 1:
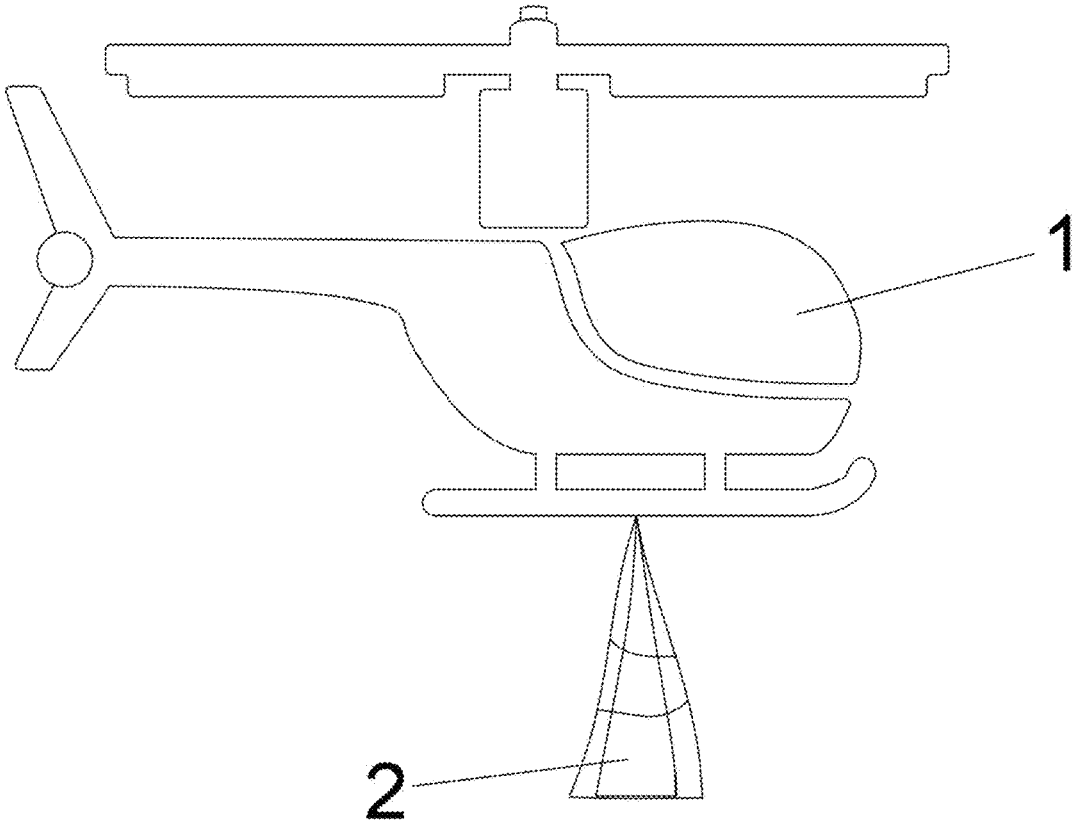
FIG. 1 is a schematic structural diagram of a catching device for surface rescue based on an aircraft platform according to an embodiment of the present disclosure.
Figure 2:
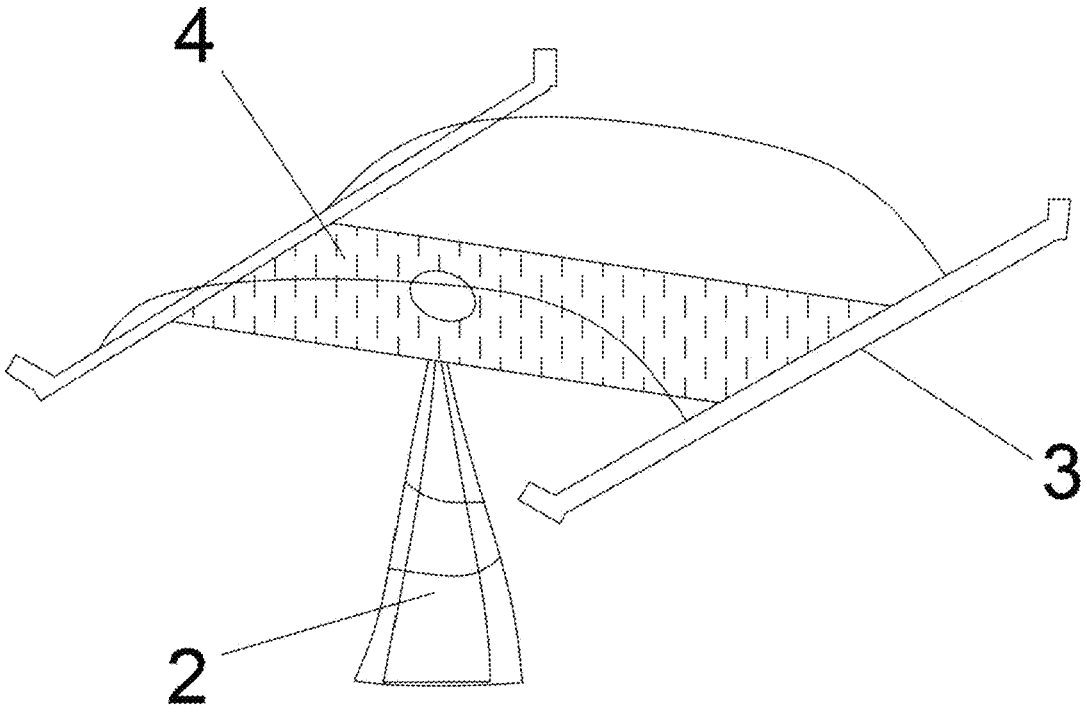
FIG. 2 is a schematic structural diagram of a suspension beam and a carrying platform.
Figure 3:
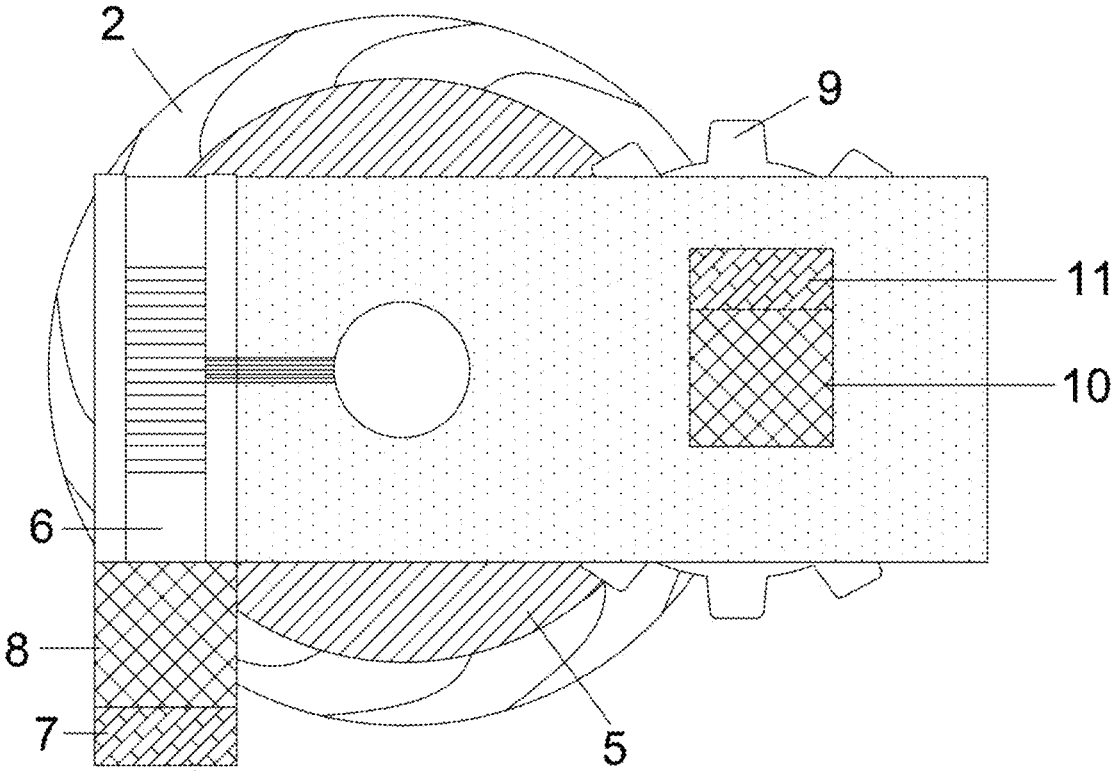
FIG. 3 is a schematic structural diagram of disposing a recovery mechanism and a torque output unit on a support plate.
Figure 4:
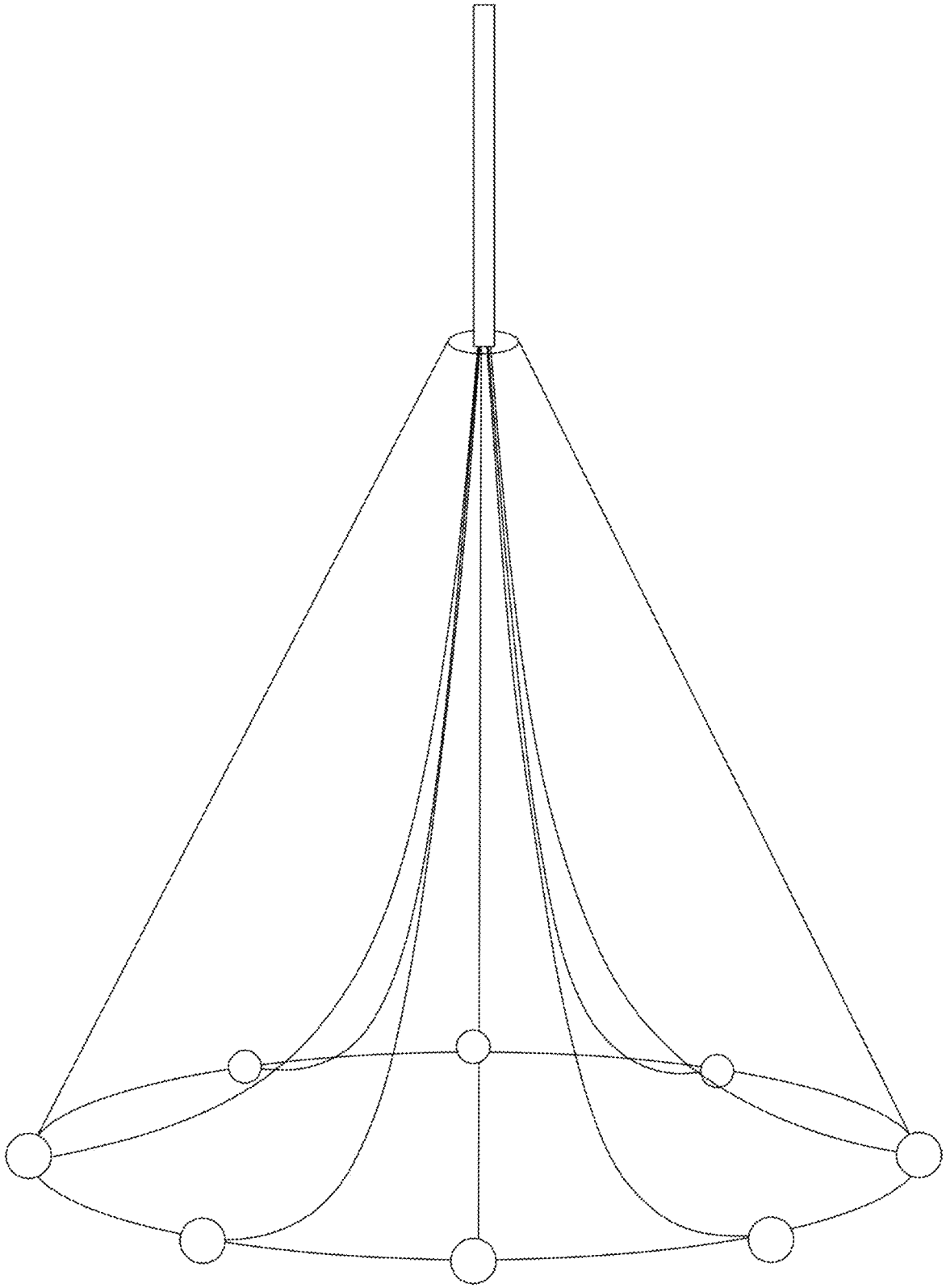
FIG. 4 is a schematic structural diagram of a catching net.
Figure 5:
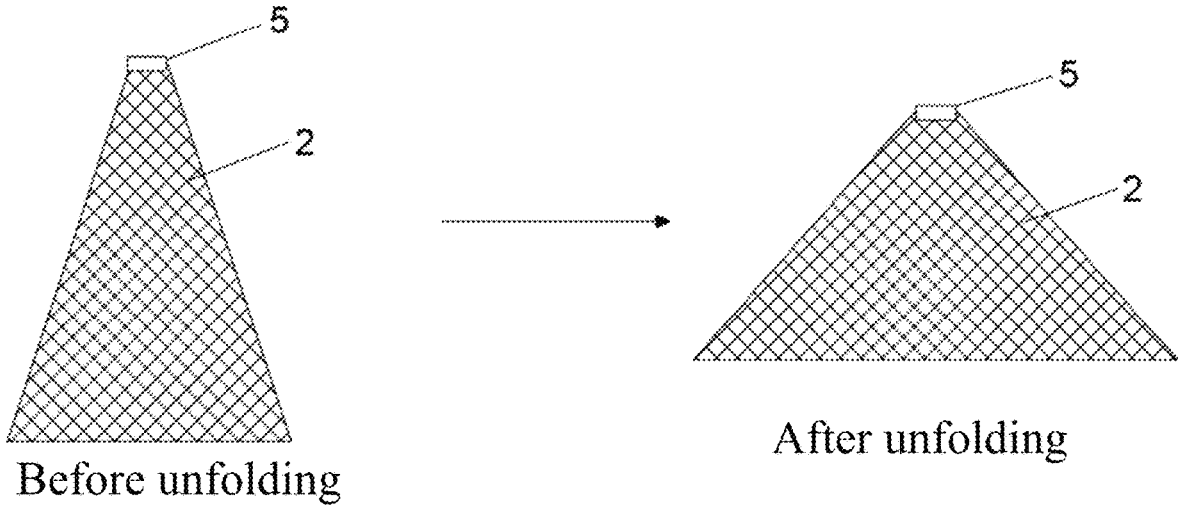
FIG. 5 schematically shows structures before and after a catching net is unfolded.
Figure 6:
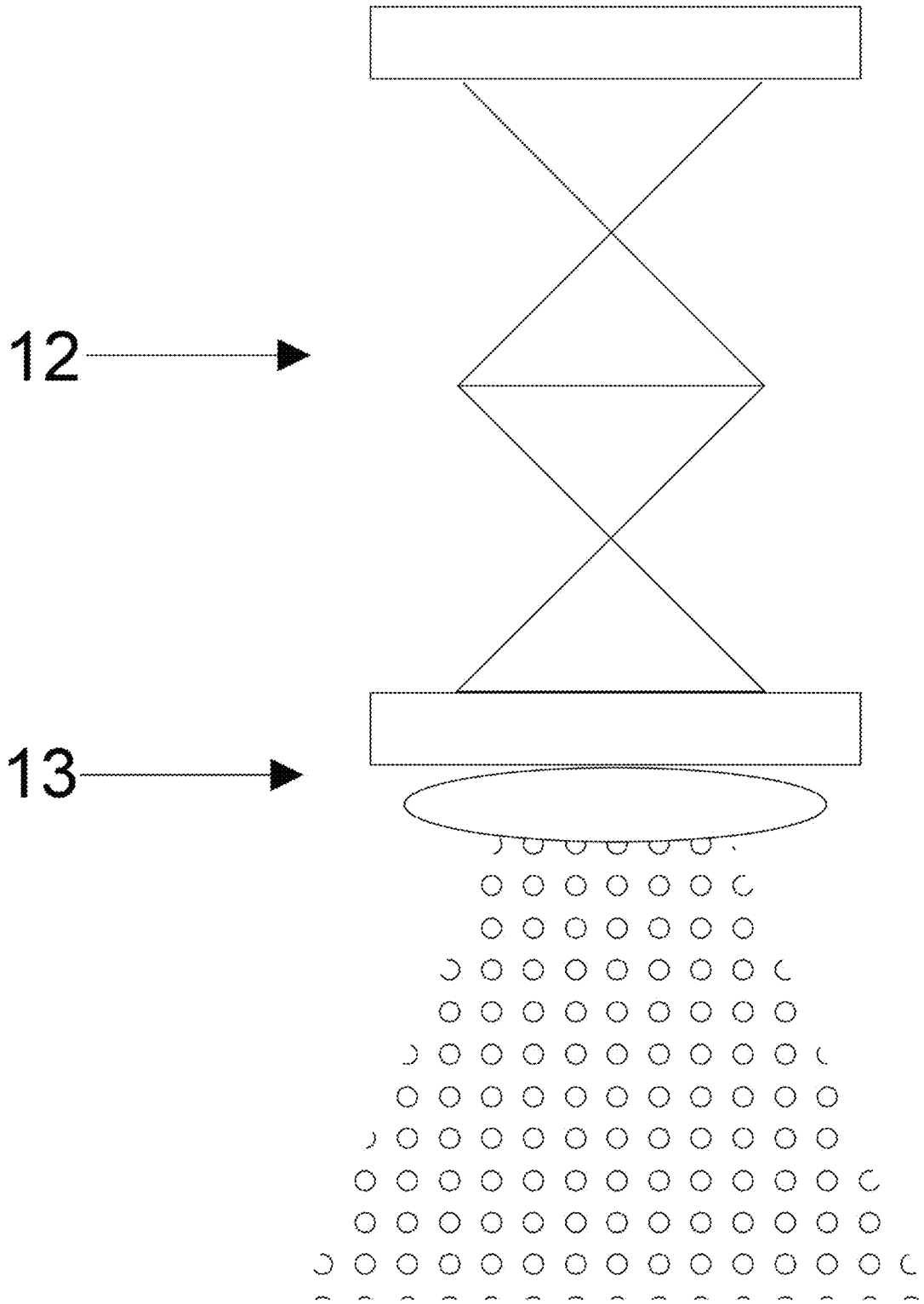
FIG. 6 is a schematic structural diagram of a throwing mechanism.
Figure 7:
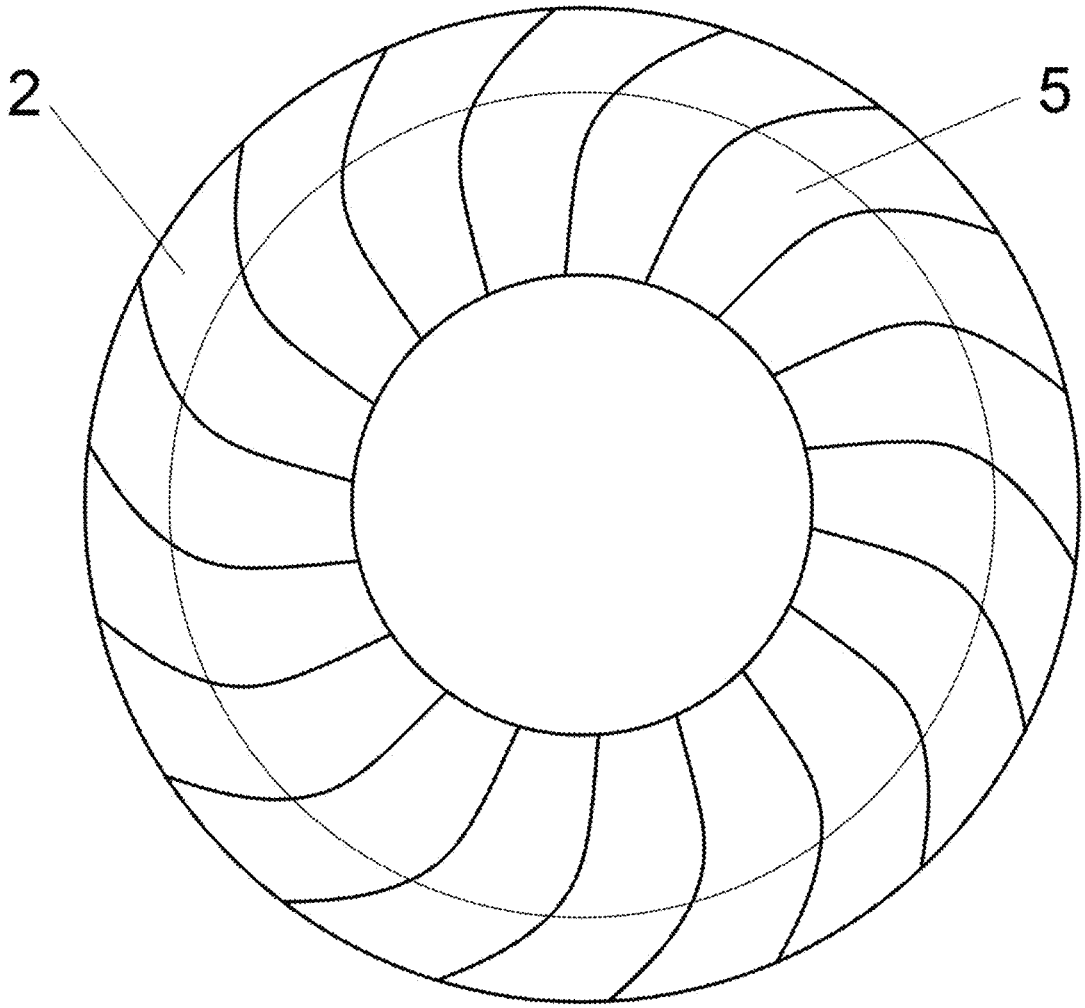
FIG. 7 is a bottom view when a throwing net wheel is connected to a catching net.

This embodiment provides a catching device for surface rescue based on an aircraft platform, which is hereinafter referred to as a surface rescue catching device. As shown in FIG. 1 to FIG. 7, the surface rescue catching device includes a throwing mechanism, a flying mechanism 1, a recovery mechanism, an automatic control module, and a catching net 2. Both the throwing mechanism and the recovery mechanism are disposed on the flying mechanism 1, and the automatic control module automatically controls the throwing mechanism and the recovery mechanism. After the flying mechanism 1 flies above a drowning person, the throwing mechanism is configured to throw the catching net 2 towards the drowning person. After the catching net 2 nets the drowning person, the recovery mechanism can drive a bottom of the catching net 2 to close, and the flying mechanism 1 is configured to drag the drowning person to a safe location.

The catching net 2 is made of an elastic mesh structure, such as a polyester mesh wire. At least one end of the catching net 2 is provided with an opening, and the other end is disposed on the throwing mechanism. The throwing mechanism provides a rotational torque to open the catching net 2 through centrifugal force to cover the drowning person.

The present disclosure utilizes the throwing mechanism, the flying mechanism 1, the recovery mechanism, the automatic control module, and the catching net 2 to achieve intelligent surface rescue. The present disclosure breaks through shortcomings of a traditional rescue method in terms of rescue efficiency, safety, and reliability, and solves a problem of rescuing a drowning person at sea.

The flying mechanism 1 in this embodiment of the present disclosure may be a drone, a manned aircraft, or the like, and can be selected based on specific needs. When the drone is used, an operator inputs a task location, namely a rescue position, and the drone flies to the rescue position on its own.

When a recognition module is adopted. The recognition module is disposed on the flying mechanism 1. When the flying mechanism 1 reaches the rescue position, the recognition module is configured to determine a relative position between the drowning person and the rescue position. If it is determined that the relative position is within a horizontal distance error $\Delta x$ and a height difference $h_1$, the automatic control module controls the throwing mechanism to throw the catching net 2 towards the drowning person.

Specific values of the $\Delta x$ and the height difference $h_1$ need to be obtained through a plurality of preliminary experiments and input into the automatic control module in advance. The recognition module can be specifically implemented using a sensor and a camera.

When the manned aircraft is used as a carrier and no recognition module is disposed, the throwing mechanism needs to be controlled for throwing through judgment of a pilot or a lifeguard on the aircraft.

There are a plurality of solutions to throwing the catching net 2. In a preferred embodiment, the throwing mechanism in the surface rescue catching device provided in this embodiment of the present disclosure includes a torque output unit 13 and a linear drive unit 12. The linear drive unit 12 is connected to the flying mechanism 1, the torque output unit 13 is disposed at a linear displacement end of the linear drive unit 12, and the linear displacement end drives the torque output unit 13 to move up and down. A torque output end of the torque output unit 13 is connected to a top of the catching net 2, and the torque output unit 13 drives the catching net 2 to rotate and unfold.

The torque output unit 13 can adopt a form of a motor driving a throwing net wheel 5, and the motor is in transmission connection with the throwing net wheel 5 to input a torque. An upper edge of the catching net 2 is disposed on the throwing net wheel 5 around a first circumference, and a centerline of the first circumference is co-linear to a central axis of the throwing net wheel 5. The linear drive unit 12 may adopt an electric push rod, and the electric push rod may adopt a product in the prior art.

In order to further improve rescue efficiency, in a preferred embodiment, when controlling the throwing mechanism to throw the catching net 2, the automatic control module first controls the torque output unit 13 to output the torque, and when the recognition module recognizes that an unfolded range of the catching net 2 is within an $S_1$ range, controls the linear drive unit 12 to drive the torque output unit 13 and the catching net 2 above the torque output unit 13 to move down until a lower edge of the catching net 2 enters water and the rescue person is netted. Specifically, an underwater penetration of the catching net 2 can be detected by disposing a corresponding sensor. When the underwater penetration reaches h2, the rescue person is netted by default.

In a preferred embodiment, the recovery mechanism includes a winding engine and a plurality of ropes. One end of each of the ropes is wound around a drum 6 of the winding engine and the other end is connected to the lower edge of the catching net 2, and the ropes are arranged around a circumference of the catching net 2. The winding engine drives the drum 6 to rotate and winds the rope onto the drum 6 to close the bottom of the catching net 2 and raise a height of the catching net 2. The winding engine is preferably disposed at the linear displacement end of the linear drive unit 12. In order to meet an installation requirement, a support plate can be fixedly disposed at the linear displacement end, and then the winding engine and the torque output unit 13 are disposed on the support plate.

The tops of the ropes need to be bundled. In addition, in order to achieve a best closure effect, all the ropes are threaded out from a top opening of the catching net 2 and wound around the drum 6. This requires setting the throwing net wheel 5 into a circular structure, with the ropes passing through a center hole of the throwing net wheel 5. Therefore, in this embodiment, the throwing net wheel 5 cannot be directly connected to a motor shaft of the motor. Edges of the throwing net wheel 5 need to be set to a tooth shape, or a coaxial driven gear ring needs to be disposed at a top or a bottom of the throwing net wheel 5, and the driven gear ring is also provided with a center hole to meet a need of threading the ropes.

In a preferred embodiment, the surface rescue catching device provided in this embodiment of the present disclosure further includes a carrying platform 4. The flying mechanism 1 is an aircraft, the throwing mechanism is disposed on the carrying platform 4, and the carrying platform 4 is disposed between two suspension beams 3 at a bottom of the aircraft.

In a preferred embodiment, the lower edge of the catching net 2 is equipped with a gravity some loop, and the gravity loop includes a retractable rope loop and a plurality of sinkers sequentially arranged around a circumference of the retractable rope loop. The gravity loop at the lower edge of the catching net 2 overcomes resistance of seawater and reaches below the drowning person. After it is determined that the drowning person is covered, the winding engine is started to furl the gravity loop, and the push rod is retracted to take the target person away from a sea surface.

Embodiment 2

This embodiment provides a surface rescue method, which adopts the surface rescue catching device described in Embodiment 1 to perform catching and rescue operations, and specifically includes the following steps:

- Step 1: After receiving a task, a flying mechanism 1 flies to a rescue position automatically or under manual control.
- Step 2: Determine whether a horizontal position error and a vertical relative height between the rescue position and a drowning person are within specified thresholds.
- Step 3: Control a throwing mechanism to throw a catching net 2 towards the drowning person.
- Step 4: A recovery mechanism drives a bottom of the catching net 2 to close, and lifts the catching net 2 upwards to approach the flying mechanism 1.
- Step 5: The flying mechanism 1 flies automatically or under the manual control, and drags the drowning person to a safe location.

Specific examples are used herein to explain the principles and implementations of the present disclosure. The foregoing description of the embodiments is merely intended to help understand the method of the present disclosure and its core ideas. Besides, various modifications may be made by those of ordinary skill in the art to specific implementations and the scope of application in accordance with the ideas of the present disclosure. In conclusion, the content of this specification shall not be construed as limitations to the present disclosure.

What is claimed is:

1. A catching device for surface rescue based on an aircraft platform, comprising a throwing mechanism, a flying mechanism, a recovery mechanism, an automatic control module, and a catching net, wherein both the throwing mechanism and the recovery mechanism are disposed on the flying mechanism, and the automatic control module automatically controls the throwing mechanism and the recovery mechanism;

after the flying mechanism flies above a drowning person, the throwing mechanism is configured to throw the catching net towards the drowning person;

after the catching net nets the drowning person, the recovery mechanism is allowed for driving a bottom of the catching net to close, and the flying mechanism is configured to drag the drowning person to a safe location; and a recognition module is further comprised and disposed on the flying mechanism, wherein when the flying mechanism reaches a rescue position, the recognition module is configured to determine a relative position between the drowning person and the rescue position;

when the relative position is determined to be within a horizontal distance error $\Delta x$ and a height difference $h_1$, the automatic control module controls the throwing mechanism to throw the catching net towards the drowning person;

the throwing mechanism comprises a torque output unit and a linear drive unit, wherein the linear drive unit is connected to the flying mechanism, the torque output unit is disposed at a linear displacement end of the linear drive unit, the linear displacement end drives the torque output unit to move up and down, a torque output end of the torque output unit is connected to a top of the catching net, and the torque output unit drives the catching net to rotate and unfold;

when controlling the throwing mechanism to throw the catching net, the automatic control module first controls the torque output unit to output a torque, and when the recognition module recognizes that an unfolded range of the catching net is within a predetermined range, controls the linear drive unit to drive the torque output unit and the catching net above the torque output unit to move down until a lower edge of the catching net enters water and the drowning person is netted; and after the bottom of the catching net is closed, the linear drive unit is allowed for driving the throwing mechanism to further drive the catching net and the drowning person inside the catching net to move up.

2. The catching device for surface rescue based on the aircraft platform according to claim 1, wherein the recovery mechanism comprises a winding engine and a plurality of ropes, wherein a first end of each of the plurality of ropes is wound around a drum of the winding engine, a second end of each of the plurality of ropes is connected to the lower edge of the catching net, and the plurality of ropes are arranged around a circumference of the catching net; and the winding engine drives the drum to rotate and winds each of the plurality of ropes onto the drum to close the bottom of the catching net and raise a height of the catching net.

3. The catching device for surface rescue based on the aircraft platform according to claim 1, further comprising a carrying platform, wherein the flying mechanism is an aircraft, the throwing mechanism is disposed on the carrying platform, and the carrying platform is disposed between two suspension beams at a bottom of the aircraft.

4. The catching device for surface rescue based on the aircraft platform according to claim 1, wherein the lower edge of the catching net is equipped with a gravity loop, and the gravity loop comprises a retractable rope loop and a plurality of sinkers sequentially arranged around a circumference of the retractable rope loop.

5. A surface rescue method, wherein the surface rescue method performs catching and rescue operations by using the catching device for surface rescue based on the aircraft platform according to claim 1, and comprises following steps:

step 1: after receiving a task, flying, by the flying mechanism automatically or under manual control, to the rescue position;

step 2: determining whether a horizontal position error and a vertical relative height between the rescue position and the drowning person are within specified thresholds;

step 3: controlling the throwing mechanism to throw the catching net towards the drowning person;

step 4: driving, by the recovery mechanism, the bottom of the catching net to close, and lifting the catching net upwards to approach the flying mechanism; and step 5: flying, by the flying mechanism automatically or under the manual control, and dragging the drowning person to the safe location.

6. The surface rescue method according to claim 5, wherein in the catching device, the recovery mechanism comprises a winding engine and a plurality of ropes, wherein a first end of each of the plurality of ropes is wound around a drum of the winding engine, a second end of each of the plurality of ropes is connected to the lower edge of the catching net, and the plurality of ropes are arranged around a circumference of the catching net; and the winding engine drives the drum to rotate and winds each of the plurality of ropes onto the drum to close the bottom of the catching net and raise a height of the catching net.

7. The surface rescue method according to claim 5, wherein the catching device further comprises a carrying platform, wherein the flying mechanism is an aircraft, the throwing mechanism is disposed on the carrying platform, and the carrying platform is disposed between two suspension beams at a bottom of the aircraft.

8. The surface rescue method according to claim 5, wherein in the catching device, the lower edge of the catching net is equipped with a gravity loop, and the gravity loop comprises a retractable rope loop and a plurality of sinkers sequentially arranged around a circumference of the retractable rope loop.

* * * * *